US005123604A

United States Patent [19]

Hammer et al.

[11] Patent Number: 5,123,604

[45] Date of Patent: Jun. 23, 1992

[54] CLAMPING MANDREL AND STRIPPING COMBINATION FOR A CORE SLEEVE OF A ROLLED WEB, PARTICULARLY A PAPER ROLL TO SUPPLY A PRINTING MACHINE

[75] Inventors: Josef Hammer, Augsburg; Walter Thuer, Friedberg, both of Fed. Rep. of Germany

[73] Assignee: Man Roland Druckmaschinen AG, Offenbach am Main, Fed. Rep. of Germany

[21] Appl. No.: 661,469

[22] Filed: Feb. 26, 1991

[30] Foreign Application Priority Data

Apr. 25, 1990 [DE] Fed. Rep. of Germany ..... 4013092

[51] Int. Cl.[5] ..... B65H 16/06

[52] U.S. Cl. ..... 242/68.4; 242/81

[58] Field of Search ..... 242/68.4, 81, 68.3, 242/72 R, 72.1; 279/2 R

[56] References Cited

U.S. PATENT DOCUMENTS 4,715,553 12/1987 Hatakeyama ..... 242/68.4

4,951,894 8/1990 Young et al. ..... 242/68.4 X

FOREIGN PATENT DOCUMENTS 7535872 4/1976 Fed. Rep. of Germany .

2814338 10/1979 Fed. Rep. of Germany .

*Primary Examiner*—John M. Jillions

*Attorney, Agent, or Firm*—Frishauf, Holtz, Goodman & Woodward

[57] ABSTRACT

An ejector ring (18) surrounds an axially movable mandrel (6), on which a core sleeve or tube (19) for a paper web roll, for example a newsprint roll, can be supported. The ejector ring is resiliently supported on the holder structure, for example on a holder arm (1) and surrounds the mandrel, and is movable parallel to the mandrel. The structure is space-saving, provides for secure retention of the mandrel and is thereby capable of supporting heavy paper rolls, while providing for reliable stripping of core sleeves off the mandrel upon retraction of the mandrel into the holder structure, for example for exchange of a paper roll.

10 Claims, 1 Drawing Sheet

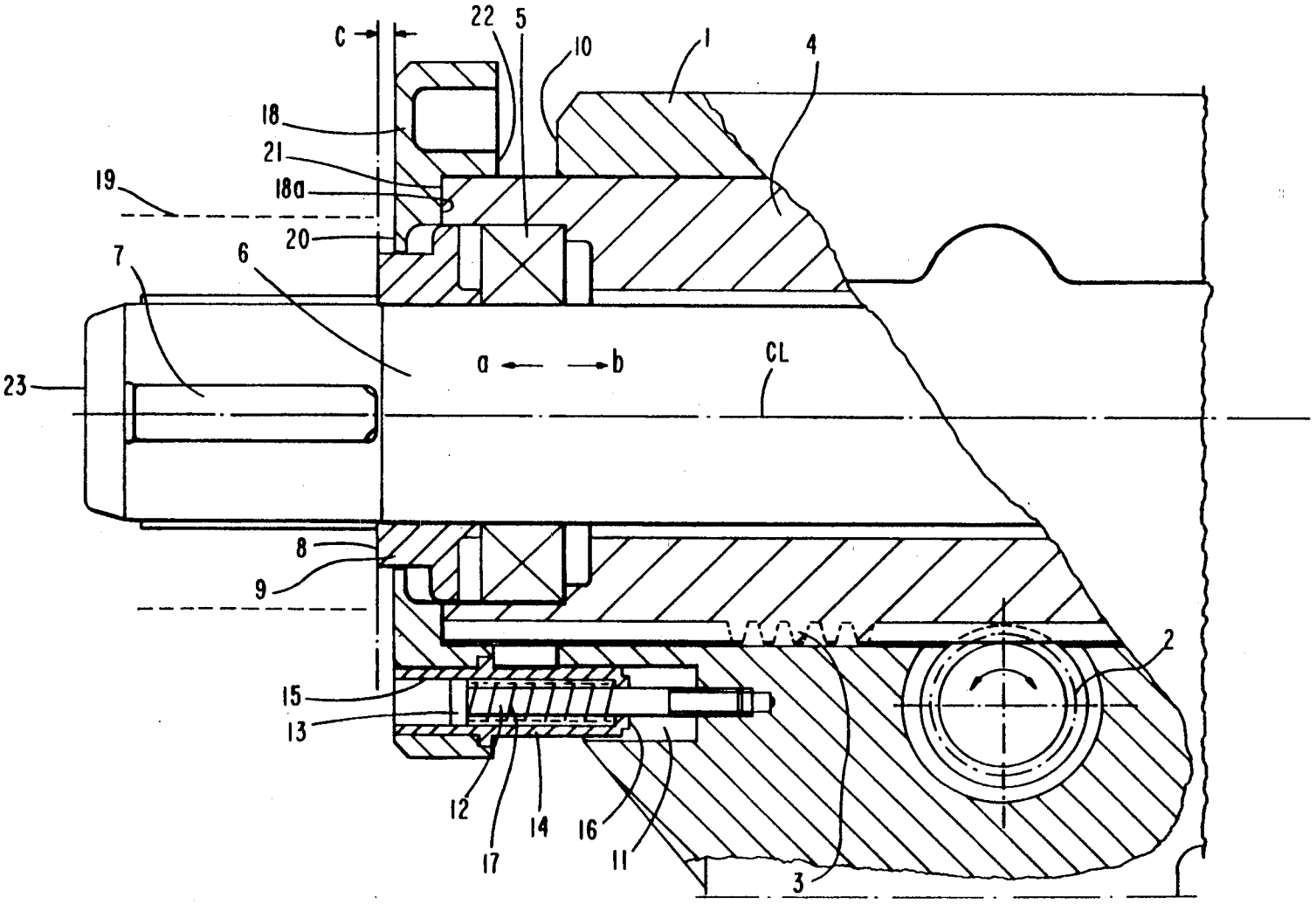
1
2
3
4
5
6
7
8
9
10
11
12
13
14
15
16
17
18
18a
19
20
21
22
23
CL
a
b
c

CLAMPING MANDREL AND STRIPPING COMBINATION FOR A CORE SLEEVE OF A ROLLED WEB, PARTICULARLY A PAPER ROLL TO SUPPLY A PRINTING MACHINE

Reference to related application, the disclosure of which is hereby incorporated by reference: U.S. Ser. No. 07/636,685, filed Jan. 2, 1991, Spang et al.

FIELD OF THE INVENTION

The present invention relates to a combination of a clamping mandrel and a stripper, in which the clamping mandrel is to retain a core sleeve for a rolled web, especially a rolled web of paper, such as newsprint or the like, to be supplied to a printing machine, in which the stripper is provided to strip the core sleeve off the mandrel when the web has been used up.

BACKGROUND

Mandrels to retain rolls of printing paper, for example newsprint, are customarily connected to a carrier arm arrangement, in which two carrier arms are located at opposite sides of the roll, with facing, projecting mandrels, for engagement within the core sleeve or core tube of the roll. The core sleeves, which may be sleeve stubs, should be removed from the mandrels when the web is used up, so that a new web can be placed on the mandrels.

Typically, the mandrels include a clamping arrangement, for example a spreader, so that the core sleeves or tubes are securely retained on the mandrel.

The carrier arm, which also retains a bearing for the mandrel, should be close to the side edge of the rolled web, without however interfering with rolling-off of the web. The placement of the edge of the web should be adjustable.

THE INVENTION

It is an object to provide a clamping mandrel with a stripper arrangement which is simple, space-saving, and does not require a separate drive for the stripper, which strips the sleeve off the mandrel.

The mandrel, which is axially movable, is supported on a holder arm, for selective insertion into the sleeve or tube of the web. An ejector ring is resiliently supported on the holder arm, the ejector ring at least in part, and preferably entirely surrounding the mandrel, and guided for movement parallel to the mandrel. Preferably, a spring is provided which, upon withdrawal of the mandrel from the sleeve, urges the ejector counter the withdrawal direction. The spring is supported at one end on the carrier arm.

The arrangement has the advantage that, even though an ejector or stripper is provided, the mandrel can be stiffly and securely retained in the carrier arm, since the arrangement permits placing the forward bearing for the carrier arm close to the forward limit of the carrier arm, without interfering with the adjustment path available for the lateral edge of the web which rolls off the web roll on the mandrel.

DRAWING

The single FIGURE is a part-longitudinal sectional view through the elements of the mandrel and the ejector, omitting features not necessary for an understanding of the invention, and its operation.

DETAILED DESCRIPTION

A carrier arm 1 supports a longitudinally movable mandrel 6. The carrier arm 1 may be formed by a fixed side wall of a printing machine or by spaced arms of a roll changer, such as a spider, or a dual roll changer apparatus. Only one such carrier arm is shown, since two carrier arms, engaging into opposite ends of the support sleeve shown only in broken lines 19 in the figure, can be identical.

The support arm 1 carries a gear 2, which engages in a rack 3 of a bearing bushing or sleeve 4. The bearing bushing 4 is axially movable within the carrier arm 1. The gear 2 can be rotated in any suitable manner, for example by hand or by a positioning motor (not shown). The mandrel 6, which is a clamping mandrel, is rotatably located within the bearing bushing 4, retained therein by a forward roller or ball bearing 5 and a further ball or roller bearing, not shown, and located within the bushing 4 at the right side of the bearing 5. The clamping mandrel 6 is axially fixed with respect to the bearing bushing 4. The free end of the clamping mandrel 6 has spreader jaws 7 located thereon, and shown only schematically, since this arrangement is well known. The spreader jaws 7 secure a sleeve or sleeve stub or tube 19 or a web on the mandrel. The end face 8 of a clamping ring 9 forms a stop for the sleeve 19.

The carrier arm 1 has an end face 10. The end face 10 is formed with a plurality of cylindrical recesses or blind bores 11. Suitably, three cylindrical bores or recesses 11 are provided, symmetrically located with respect to the axis or center line CL if the mandrel 6. A guide pin 12 is located in each one of the cylindrical recesses or bores 11. The guide pins 12 each have a cylindrical head 13 of wider diameter. A guide sleeve 14 is located to slide about the head 13, the guide sleeve 14 having an inner guide or slide surface 15. The sleeve 14 has an interiorly diametrically extending projection 16 at the inner end thereof, in which the pin 12 can slide. The ring-shaped inner diametric extending projection 16 also forms a counter bearing for one end of a spiral compression spring 17, which surrounds the guide pin 12. The other end of the compression spring 17 is engaged against the inner side, or right side in the drawing, of the head 13 of the guide pin 12.

An ejector ring or stripper 18 is secured to the guide sleeve 14. The ejector ring or stripper 18 surrounds the clamping mandrel 6 from the outside. The inner diameter of the stripper 18 is only slightly greater than the outer diameter of the clamping ring 9 adjacent the end surface 8 thereof; the inner diameter of the ejector or stripper 18 is smaller than the outer diameter of the sleeve or tube 19, shown only in broken lines.

The end surface 20 of the ejector ring or stripper 18 is shown, as drawn, in the position in which the mandrel 6 has been projected in the direction of the arrow a for a distance required to clamp a sleeve or tube or end stub of a paper web roll on the mandrel. the spring 17 ensures that the ejector ring surface **18*a* engages the end surface 21 of the bushing 4 under spring force, while maintaining, at all times, a small gap or clearance space c. This clearing space prevents engagement of the static ejector ring 18 against the rotating sleeve or tube 19 of a web. The arrangement further permits adjustment of the position of the lateral edge of the web which rolls off the sleeve 19 by moving the mandrel 6 either in the direction of the arrows a or b, without any axially acting force acting from the ejector ring 18 on the sleeve 19 secured to the mandrel 6**.

OPERATION

To eject a sleeve 19 from a position on the mandrel 6, the mandrel 6, together with the sleeve 4, is moved in the direction of the arrow b by rotation of the gear 2. When the mandrel 6 has been retracted to the extent that the rearward facing surface 22 of the ejector ring or stripper 18 engages the facing surface 10 of the carrier arm 1, the ejector ring or stripper 18 becomes stationary and applies a force in a direction to strip the sleeve or holding tube or stub off the mandrel 6. The mandrel 6 can then be retracted into the carrier arm 1, by continued rotation of the gear 2, in engagement with the rack 3 until the leading edge 23 of the mandrel 6 is retracted beneath the facing surface 20 of the ejector ring or stripper 18. Thus, reliable stripping of the sleeve or tube 19 off the mandrel is ensured.

Various changes and modifications may be made within the scope of the inventive concept.

We claim:

1. Clamping mandrel (6) and stripping means (18) combination for a core sleeve (19) of a rolled web, particularly a paper web roll for supply of paper webs to a printing machine, said combination having a holder means (1) defining an end face;

a mandrel (6) axially movably supported by the holder means and insertable into said core sleeve (19), and retractable from said core sleeve into said holder means, and comprising a plurality of guide pins (12) projecting from said end face;

a guide sleeve (14) slidably located on each one of the guide pins (12);

an ejector ring (18) resiliently supported on the holder means (1), at least in part surrounding the mandrel (6) and movable parallel with respect to the mandrel;

and wherein said ejector ring (18) is coupled to said guide sleeves (14).

2. The combination of claim 1, wherein said ejector ring (18) entirely surrounds said mandrel (6).

3. The combination of claim 1, wherein the guide pins (12) each have a cylindrical head (13), said guide sleeves (14) surrounding said cylindrical head and being guided thereby;

said guide sleeves, further, having a diametrically inwardly extending projection (16) surrounding the respective guide pin, and slidable on the respective guide pin; and a spring (17) is provided, surrounding the guide pin and positioned between the head (13) of the respective guide pin and said inward extension (16) of the guide sleeve (14).

4. The combination of claim 3, wherein said ejector ring (18) entirely surrounds said mandrel (6).

5. The combination of claim 3, further including a bearing bushing (4), axially movable within said holder means (1);

an axially fixed bearing means (5) coupling the bearing bushing to the mandrel (6), whereby, upon axial movement of the bearing bushing, the mandrel will move axially with the bearing bushing;

wherein said end face forms an abutment for said ejector ring (18) upon movement of the mandrel axially out of said core sleeve (19); and wherein the ejector ring (18) is formed with an abutment surface (18*a*) engageable against an engagement surface (21) of said bearing sleeve (4), said engagement surface being recessed with respect to an end face (8) of the bearing sleeve to define, with the ejector ring (18), a gap (c) to permit lateral side adjustment of a wbe rolled on said core sleeve (19).

6. The combination of claim 5, wherein said ejector ring (18) entirely surrounds said mandrel (6).

7. The combination of claim 1, further including a bearing bushing (4), axially movable within said holder means (1);

an axially fixed bearing means (5) coupling the bearing bushing to the mandrel (6), whereby, upon axial movement of the bearing bushing, the mandrel will move axially with the bearing bushing;

wherein said end face forms an abutment for said ejector ring (18) upon movement of the mandrel axially out of said core sleeve (19); and wherein the ejector ring (18) is formed with an abutment surface (18*a*) engageable against an engagement surface (21) of said bearing sleeve (4), said engagement surface being recessed with respect to an end face (8) of the bearing sleeve to define, with the ejector ring (18), a gap (c) to permit lateral side adjustment of a web rolled on said core sleeve (19).

8. The combination of claim 7, wherein said ejector ring (18) entirely surrounds said mandrel (6).

9. Clamping mandrel (6) and stripping means (18) combination for a core sleeve (19) of a rolled web, particularly a paper web roll for supply of paper webs to a printing machine, said combination having a holder means (1) defining an end face;

a mandrel (6) axially movably supported by the holder means and insertable into said core sleeve (19), and retractable from said core sleeve into said holder means, and comprising an ejector ring (18) resiliently supported on the holder means (1), at least in part surrounding the mandrel (6) and movable parallel with respect to the mandrel;

a bearing bushing (4), axially movable within said holder means (1);

an axially fixed bearing means (5) coupling the bearing bushing to the mandrel (6), whereby, upon axial movement of the bearing bushing, the mandrel will move axially with the bearing bushing;

wherein said end face forms an abutment for said ejector ring (18) upon movement of the mandrel axially out of said core sleeve (19); and wherein the ejector ring (18) is formed with an abutment surface (18*a*) engageable against an engagement surface (21) of said bearing sleeve (4), said engagement surface being recessed with respect to an end face (8) of the bearing sleeve to define, with the ejector ring (18), a gap (c) to permit lateral side adjustment of a web rolled on said core sleeve (19).

10. The combination of claim 9, wherein said ejector ring (18) entirely surrounds said mandrel (6).

* * * * *